US006253688B1

(12) United States Patent
Lor

(10) Patent No.: US 6,253,688 B1
(45) Date of Patent: Jul. 3, 2001

(54) PORTABLE TABLE

(76) Inventor: Frank Lor, 1367 Pawtucket Blvd. #33, Lowell, MA (US) 01854

( * ) Notice: Subject to any disclaimer, the term of this patent is extended or adjusted under 35 U.S.C. 154(b) by 0 days.

(21) Appl. No.: 09/522,505

(22) Filed: Mar. 10, 2000

(51) Int. Cl.[7] ..... A47B 3/00
(52) U.S. Cl. ..... 108/132; 108/129
(58) Field of Search ..... 108/129, 132, 108/131

(56) References Cited

U.S. PATENT DOCUMENTS

| | | | | |
|---|---|---|---|---|
| D. 311,828 | | 11/1990 | Clark et al. . | |
| 1,204,390 | * | 11/1916 | Armstead | 108/131 |
| 2,490,318 | * | 12/1949 | Padon | 108/131 |
| 3,123,935 | | 3/1964 | Williams . | |
| 3,821,936 | | 7/1974 | Mores . | |
| 4,311,099 | | 1/1982 | Roberts . | |
| 4,404,915 | | 9/1983 | Simpson . | |
| 4,765,583 | | 8/1988 | Tenner . | |

FOREIGN PATENT DOCUMENTS

| | | | | |
|---|---|---|---|---|
| 250194 | * | 3/1964 | (AU) | 108/132 |

* cited by examiner

*Primary Examiner*—Peter M. Cuomo
*Assistant Examiner*—Jerry A. Anderson

(57) ABSTRACT

A portable table for providing a useful and stable table surface raised above a surface such as a floor or bed and that may be easily and quickly collapsed into a more compact form for convenient transport and storage. The portable table includes a tabletop member, a support apparatus that includes a pivotally movable leg member designed for movement between a extended and stored position as well as an attachment assembly, for the purpose of coupling the support apparatus to the tabletop member, and a locking assembly designed for locking the leg member in the deployed position.

8 Claims, 2 Drawing Sheets

PORTABLE TABLE

BACKGROUND OF THE INVENTION

1. Field of the Invention

The present invention relates to portable tables and more particularly pertains to a new portable table for providing a useful and stable table surface raised above a surface such as a floor or bed and that may be easily and quickly collapsed into a more compact form for convenient transport and storage.

2. Description of the Prior Art

The use of portable tables is known in the prior art. More specifically, portable tables heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,311,099; U.S. Pat. No. 3,123,935; U.S. Pat. No. 4,765,583; U.S. Pat. No. 3,821,936; U.S. Pat. No. 4,404,915; and U.S. Pat. No. Des. 311,828.

While these devices fulfill their respective, particular objectives and requirements, the aforementioned patents do not disclose a new portable table. The inventive device includes a tabletop member, a support apparatus that includes a pivotally movable leg member designed for movement between a extended and stored position as well as an attachment assembly, for the purpose of coupling the support apparatus to the tabletop member, and a locking assembly designed for locking the leg member in the deployed position.

In these respects, the portable table according to the present invention substantially departs from the conventional concepts and designs of the prior art, and in so doing provides an apparatus primarily developed for the purpose of providing a useful and stable table surface raised above a surface such as a floor or bed and that may be easily and quickly collapsed into a more compact form for convenient transport and storage.

SUMMARY OF THE INVENTION

In view of the foregoing disadvantages inherent in the known types of portable tables now present in the prior art, the present invention provides a new portable table construction wherein the same can be utilized for providing a useful and stable table surface raised above a surface such as a floor or bed and that may be easily and quickly collapsed into a more compact form for convenient transport and storage.

The general purpose of the present invention, which will be described subsequently in greater detail, is to provide a new portable table apparatus and method which has many of the advantages of the portable tables mentioned heretofore and many novel features that result in a new portable table which is not anticipated, rendered obvious, suggested, or even implied by any of the prior art portable tables, either alone or in any combination thereof.

To attain this, the present invention generally comprises a tabletop member, a support apparatus that includes a pivotally movable leg member designed for movement between a extended and stored position as well as an attachment assembly, for the purpose of coupling the support apparatus to the tabletop member, and a locking assembly designed for locking the leg member in the deployed position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable table apparatus and method which has many of the advantages of the portable tables mentioned heretofore and many novel features that result in a new portable table which is not anticipated, rendered obvious, suggested, or even implied by any of the prior art portable tables, either alone or in any combination thereof.

It is another object of the present invention to provide a new portable table which may be easily and efficiently manufactured and marketed.

It is a further object of the present invention to provide a new portable table which is of a durable and reliable construction.

An even further object of the present invention is to provide a new portable table which is susceptible of a low cost of manufacture with regard to both materials and labor, and which accordingly is then susceptible of low prices of sale to the consuming public, thereby making such portable table economically available to the buying public.

Still yet another object of the present invention is to provide a new portable table which provides in the apparatuses and methods of the prior art some of the advantages thereof, while simultaneously overcoming some of the disadvantages normally associated therewith.

Still another object of the present invention is to provide a new portable table for providing a useful and stable table surface raised above a surface such as a floor or bed and that may be easily and quickly collapsed into a more compact form for convenient transport and storage.

Yet another object of the present invention is to provide a new portable table which includes a tabletop member, a support apparatus that includes a pivotally movable leg member designed for movement between a extended and stored position as well as an attachment assembly, for the purpose of coupling the support apparatus to the tabletop member, and a locking assembly designed for locking the leg member in the deployed position.

Still yet another object of the present invention is to provide a new portable table that permits secure locking of the leg members in a deployed position for providing a stable tabletop surface while permitting easy unlocking for moving the leg members to a stored position.

Even still another object of the present invention is to provide a new portable table that permits the legs of the user to being fully extended, or even crossed with each other, in a position beneath the tabletop without interfering with the leg members of the device.

These together with other objects of the invention, along with the various features of novelty which characterize the invention, are pointed out with particularity in the claims annexed to and forming a part of this disclosure. For a better understanding of the invention its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
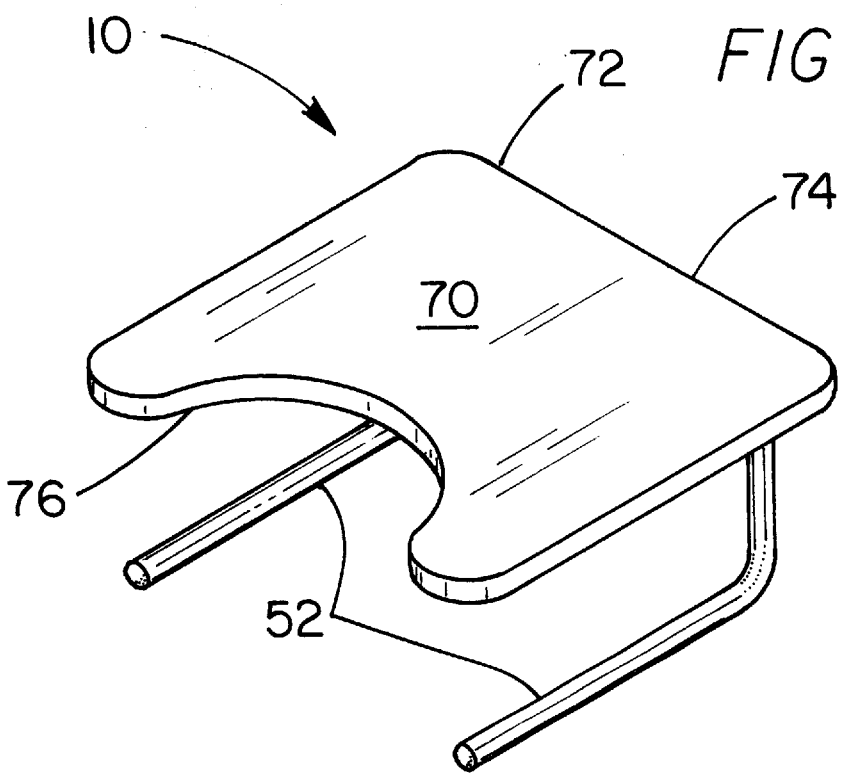
FIG. 1 is a top view of a new portable table according to the present invention with the support apparatus in a fully deployed form.
Figure 2:
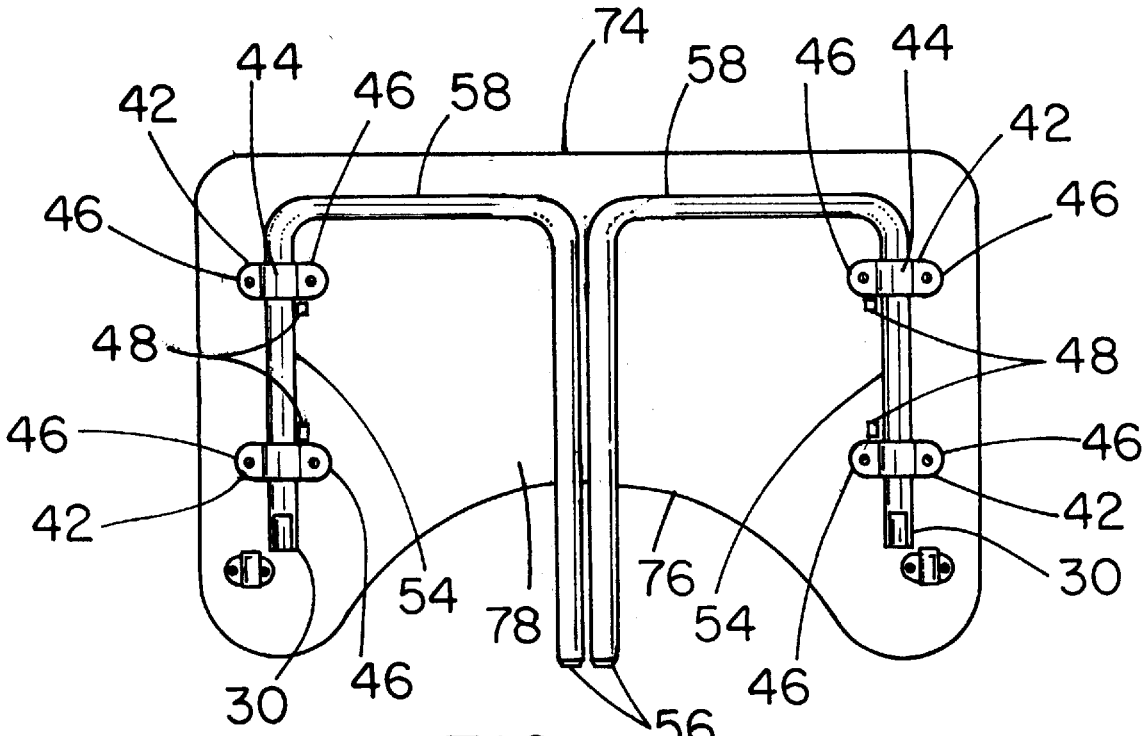
FIG. 2 is a bottom view of the present invention with the support apparatus in a collapsed form.
Figure 3:
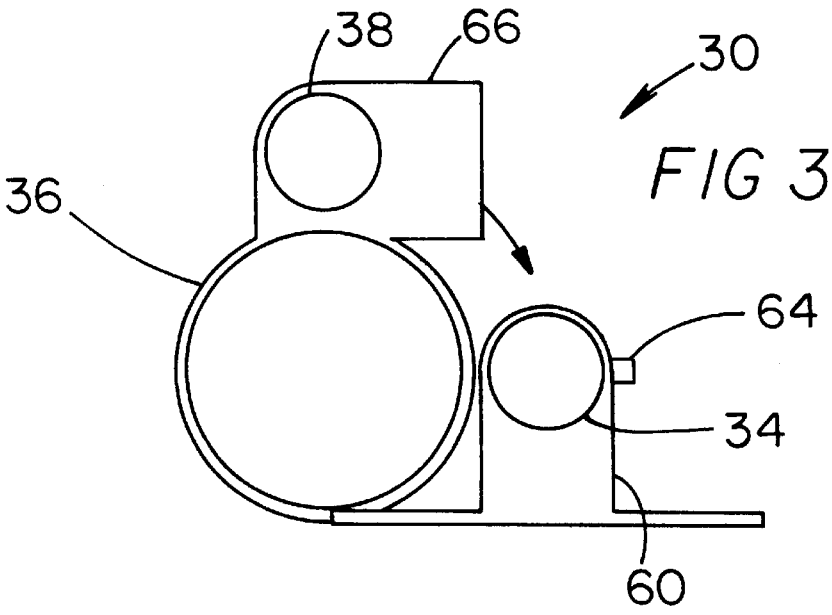
FIG. 3 is a cross-section of the side view of the locking assembly of the present invention.
Figure 4:
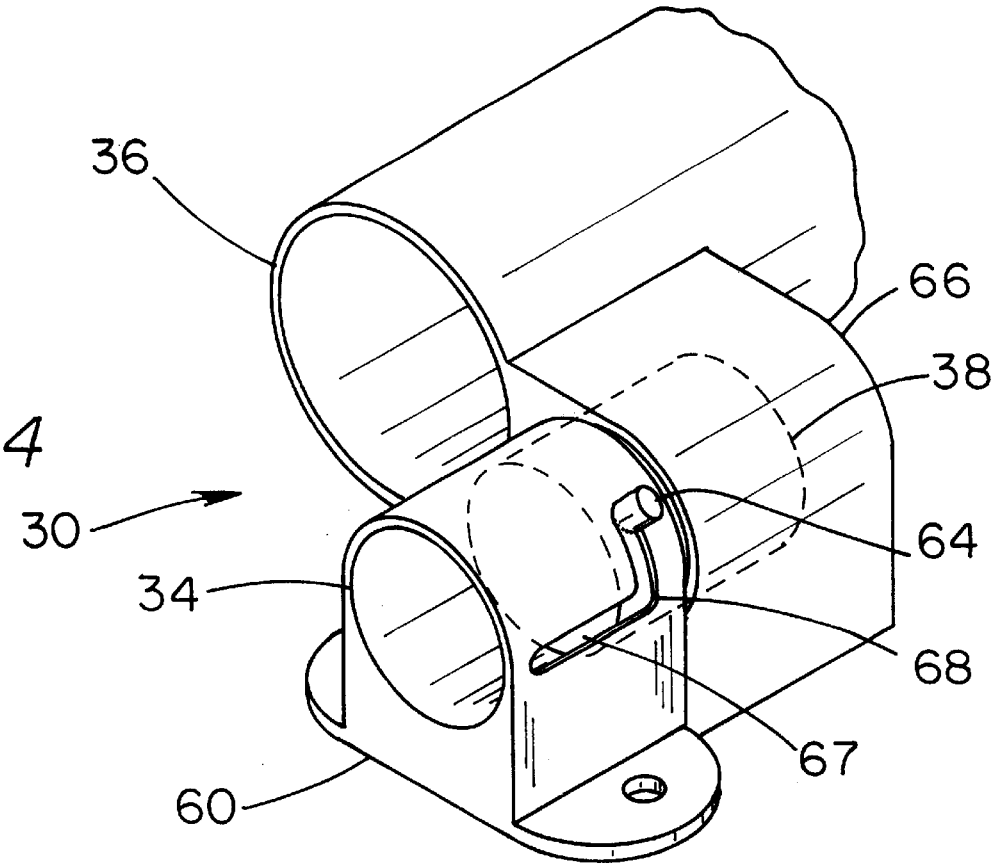
FIG. 4 is a magnified view of the attachment assembly and locking assembly of the present invention.

With reference now to the drawings, and in particular to FIGS. 1 through 6 thereof, a new portable table embodying the principles and concepts of the present invention and generally designated by the reference numeral 10 will be described.

As best illustrated in FIGS. 1 through 6, the portable table 10 generally comprises a tabletop member 70 for resting articles thereon, a support apparatus 20 that includes leg members 52 for supporting the tabletop member 70 and an attachment assembly 40 for attaching the leg members 52 to the tabletop member 70, and a locking assembly 30 to lock the supporting apparatus 20 in a deployed position.

The tabletop member 70 is designed for resting articles thereon. The tabletop member 70 includes a lower surface 78 and an upper surface 72. The tabletop member 70 includes a front edge 74 for positioning away from a user and a rear edge 76 for positioning toward a user. The rear edge 76 of the tabletop member 70 is arcuate so as to fit a portion of the torso of a user. The distance between the front and rear edges 74 and 76 of the tabletop member 70 at the longest part is twenty (20) inches. The distance between the front edge 74 and at the top of the arcuate part of the rear edge 76 is thirteen (13) inches. The diameter of the arcuate edge is sixteen (16) inches.

A support apparatus 20 is designed for supporting the tabletop member 70 above a surface. The support apparatus 20 includes a pair of leg assemblies 50. Each leg assembly 50 includes a leg member 52 and an attachment assembly 40.

The leg member 52 is pivotally movable between a deployed position and a stored position. The leg member 52 includes an attachment portion 54, resting portion 56 and a upstanding portion 58 extending between the attachment portion 54 and the resting portion 56. The length of the attachment portion 54 of the leg member 52 is thirteen and a half (13½) inches. The length of the resting portion 56 of the leg member 52 is ten and a half (10½) inches. The length of the upstanding portion 58 of the leg member 52 is fifteen and three-quarters (15¾) inches.

The attachment assembly 40 is designed for attaching the attachment portion 54 of the leg member 52 to the lower surface 78 of the tabletop member 70. The attachment assembly 40 includes a pair of brackets 42 mounted to the lower surface 78 of the tabletop member 70. Each of the brackets 42 includes a central portion 44 embracing a portion of the attachment portion 54 of the leg member 52. Each of the brackets 42 also includes a pair of end tabs 46 extending from the central portion 44 and is secured to the lower surface 78 of the tabletop member 70. The attachment assembly 40 includes a pair of stops 48 mounted to the attachment portion 54 of the leg member 52. Each of the stops 48 is positioned adjacent to one of the brackets 42 to resist the sliding movement of the attachment portion 54 of the leg member 52 with respect to the brackets 42 and the tabletop member 70.

The locking assembly 30 is adapted for selectively locking the leg member 52 in the deployed position. The locking assembly 30 includes a locking member 60 mounted on the lower surface 78 of the tabletop member 70 adjacent to the attachment portion 54 of the leg member 52. The locking member 60 includes a first channel 34 throughout, with a locking ear 36 mounted on the attachment portion 54 of the leg member 52. The locking ear 36 includes a second channel 38 in alignment with the first channel 34 of the locking member 60 when the leg member 52 is positioned in the deployed position. A locking slider 39 is movable between a retracted position in the first channel 34 and an extended position in the first and second channels 34 and 38 for resisting movement of the locking ear 36 with respect to the locking member 60.

The locking member 60 has a locking slot 62 extending through with a perimeter wall of the locking member 60. The locking slot 62 includes a first portion 67 extending parallel to a longitudinal axis of the first channel 34 and a second portion 68 extending substantially perpendicular to the first portion 67 of the locking slot 62. A locking peg 64 extends from an exterior surface of the locking slider 39 and protrudes into the locking slot 62. The locking peg 64 is in the second portion 68 of the locking slot 62 when the locking slider 39 is extended into the second channel 38 of the locking member 60.

The locking ear 36 has a locking tab 66 extending from the locking ear 36. The locking tab 66 abuts against the lower surface 78 of the tabletop member 70 when the leg member 52 is in the deployed position for facilitating the alignment of the first channel 34 and the second channel 38.

The resting portion 56 of one of the leg members 52 is positioned adjacent to the resting portion 56 of the other of the leg members 52 when the leg members 52 are in the stored position.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A collapsible portable table, comprising:

a tabletop member for resting articles thereon, the tabletop member having a lower surface;

a support apparatus for supporting the table top member above a surface, the support apparatus comprising a pair of leg assemblies, each of the leg assemblies comprising:

a leg member, the leg member being pivotally movable between a deployed position and a stored position, an attachment assembly for attaching the leg member to the lower surface of the tabletop member;

a locking assembly for selectively locking the leg member in the deployed position wherein the leg member has an attachment portion, resting portion and a upstanding portion extending between the attachment portion and the resting portion;

wherein the locking assembly comprises a locking member mounted on the lower surface of the tabletop member adjacent to the attachment portion of the leg member, the locking member having a first channel therethrough, a locking ear mounted on the attachment portion of the leg member, the locking ear having a second channel alignable with the first channel of the locking member when the leg member is positioned in the deployed position, a locking slider movable between a retracted position in the first channel and an extended position in the first and second channels for resisting movement of the locking ear with respect to the locking member; and wherein the locking member has a locking slot extending through with a perimeter wall of the locking member, the locking slot having a first portion extending parallel to a longitudinal axis of the first channel and a second portion extending substantially perpendicular to the first portion of the locking slot, a locking peg extending from an exterior surface of the locking slider and protruding into the locking slot, the locking peg being in the second portion of the locking slot when the locking slider is extended into the second channel of the locking member.

2. The apparatus of claim 1, wherein the resting portion of one of the leg members is positioned adjacent to the resting portion of the other of the leg members when the leg members are in the stored position.

3. The apparatus of claim 1, additionally comprising a tabletop member having a front edge for positioning away from a user and a rear edge for positioning toward a user, the rear edge of the tabletop member being arcuate for receiving a portion of the torso of a user.

4. The apparatus of claim 1, additionally comprising an attachment assembly comprising a pair of brackets mounted to the lower surface of the tabletop member, each of the brackets having a central portion embracing a portion of the attachment portion of the leg member.

5. The apparatus of claim 4 wherein each of the brackets having a pair of end tabs extending from the central portion and being secured to the lower surface of the tabletop member.

6. The apparatus of claim 4 wherein the attachment assembly includes a pair of stops mounted to the attachment portion of the leg member, each of the stops being positioned adjacent to one of the brackets to resist sliding movement of the attachment portion of the leg member with respect to the brackets and the tabletop member.

7. The apparatus of claim 1, wherein the locking ear has a locking tab extending therefrom, the locking tab abutting against the lower surface of the tabletop member when the leg member is in the deployed position for facilitating the alignment of the first channel and the second channel.

8. A collapsible portable table, comprising:

a tabletop member for resting articles thereon, the tabletop member having a lower surface, the tabletop member having an upper surface, the tabletop member having a front edge for positioning away from a user and a rear edge for positioning toward a user, the rear edge of the tabletop member being arcuate for receiving a portion of the torso of a user;

a support apparatus for supporting the table top member above a surface, the support apparatus comprising a pair of leg assemblies, each of the leg assemblies comprising:

a leg member, the leg member being pivotally movable between a deployed position and a stored position, the leg member having an attachment portion, resting portion and a upstanding portion extending between the attachment portion and the resting portion;

an attachment assembly for attaching the attachment portion of the leg member to the lower surface of the tabletop member, the attachment assembly comprising a pair of brackets mounted to the lower surface of the tabletop member, each of the brackets having a central portion embracing a portion of the attachment portion of the leg member, each of the brackets having a pair of end tabs extending from the central portion and being secured to the lower surface of the tabletop member, the attachment assembly including a pair of stops mounted to the attachment portion of the leg member, each of the stops being positioned adjacent to one of the brackets to resist sliding movement of the attachment portion of the leg member with respect to the brackets and the tabletop member;

a locking assembly for selectively locking the leg member in the deployed position, the locking assembly comprising a locking member mounted on the lower surface of the tabletop member adjacent to the attachment portion of the leg member, the locking member having a first channel therethrough, a locking ear mounted on the attachment portion of the leg member, the locking ear having a second channel alignable with the first channel of the locking member when the leg member is positioned in the deployed position, a locking slider movable between a retracted position in the first channel and an extended position in the first and second channels for resisting movement of the locking ear with respect to the locking member, wherein the locking member has a locking slot extending through with a perimeter wall of the locking member, the locking slot having a first portion extending parallel to a longitudinal axis of the first channel and a second portion extending substantially perpendicular to the first portion of the locking slot, a locking peg extending from an exterior surface of the locking slider and protruding into the locking slot, the locking peg being in the second portion of the locking slot when the locking slider is extended into the second channel of the locking member;

wherein the locking ear has a locking tab extending therefrom, the locking tab abutting against the lower surface of the tabletop member when the leg member is in the deployed position for facilitating the alignment of the first channel and the second channel;

wherein the resting portion of one of the leg members is positioned adjacent to the resting portion of the other of the leg members when the leg members are in the stored position.

* * * * *